US009759443B2

(12) United States Patent
Bauer

(10) Patent No.: US 9,759,443 B2
(45) Date of Patent: Sep. 12, 2017

(54) METHOD FOR OPERATING A VENTILATION SYSTEM WITH A MIXING CHAMBER

(75) Inventor: Albert Bauer, München (DE)

(73) Assignee: Robert Bosch GmbH, Stuttgart (DE)

( * ) Notice: Subject to any disclaimer, the term of this patent is extended or adjusted under 35 U.S.C. 154(b) by 875 days.

(21) Appl. No.: 13/983,356

(22) PCT Filed: Dec. 9, 2011

(86) PCT No.: PCT/EP2011/072329

§ 371 (c)(1),
(2), (4) Date: Oct. 16, 2013

(87) PCT Pub. No.: WO2012/103979

PCT Pub. Date: Aug. 9, 2012

(65) Prior Publication Data

US 2014/0051345 A1 Feb. 20, 2014

(30) Foreign Application Priority Data

Feb. 4, 2011 (DE) ..... 10 2011 000 525

(51) Int. Cl.
*F24F 13/04* (2006.01)
*F24F 13/14* (2006.01)
(Continued)

(52) U.S. Cl.
CPC ..... *F24F 13/04* (2013.01); *F24F 3/0522* (2013.01); *F24F 13/10* (2013.01); *F24F 13/1413* (2013.01)

(58) Field of Classification Search
CPC ..... Y10T 137/87467; F24F 13/1413; F24F 13/04; F24F 13/10; F24F 3/0522
(Continued)

(56) References Cited

U.S. PATENT DOCUMENTS 2,074,518 A * 3/1937 Sandberg ..... F24F 13/081 138/DIG. 4
2,224,312 A * 12/1940 O'Day ..... F24F 13/06 454/320

(Continued)

FOREIGN PATENT DOCUMENTS

CH 284749 A 8/1952
DE 1451652 U 2/1937

(Continued)

OTHER PUBLICATIONS

International Search Report corresponding to PCT Application No. PCT/EP2011/072329, mailed Apr. 17, 2012 (German and English language document) (7 pages).

*Primary Examiner* — Steven B McAllister
*Assistant Examiner* — Jonathan Cotov
(74) *Attorney, Agent, or Firm* — Maginot, Moore & Beck LLP

(57) ABSTRACT

The disclosure relates to a method for operating a ventilation system with a mixing chamber into which air is supplied via a first supply duct and via at least one further supply duct. Air is removed from the mixing chamber by a removal duct. The supply of air—volume control—into the mixing chamber from the supply ducts is controlled in each case via flaps with a plurality of flap leaves and/or a plurality of flap units each having a plurality of intercoupled flap leaves. According to the disclosure, the flap leaves and/or the flap units are activated individually, and an individual opening position of the respective flap leaves or of the flap units with the flap leaves is made possible.

13 Claims, 4 Drawing Sheets

(51) Int. Cl.
*F24F 3/052* (2006.01)
*F24F 13/10* (2006.01)

(58) Field of Classification Search
USPC ..... 454/261, 267
See application file for complete search history.

(56) References Cited

U.S. PATENT DOCUMENTS 2,293,065 A * 8/1942 Kiczales ..... F24F 13/15 454/335
2,684,690 A * 7/1954 Lee ..... D21F 1/02 137/601.08
3,901,275 A * 8/1975 Logsdon ..... F16K 11/052 137/599.03
4,259,987 A * 4/1981 Janssen ..... F24F 13/14 137/601.09
4,453,321 A * 6/1984 McDonald ..... B21C 29/00 34/182
4,570,533 A * 2/1986 Sugawara ..... F24F 13/072 137/601.08
4,677,904 A * 7/1987 Natsumeda ..... F15D 1/08 454/266
5,180,333 A * 1/1993 Shyu ..... F24F 11/00 236/49.3
8,640,479 B2 * 2/2014 Bettella ..... F04D 25/12 62/186
2005/0279843 A1 * 12/2005 Dieksander ..... B60H 1/00028 236/49.3
2006/0183419 A1 * 8/2006 Kettler ..... F24F 11/0009 454/261
2012/0156981 A1 * 6/2012 Curtin ..... H05K 7/20836 454/184

FOREIGN PATENT DOCUMENTS

DE 14 54 652 2/1969
DE 87 07 488 U1 8/1987
EP 1 096 208 A2 5/2001

* cited by examiner

METHOD FOR OPERATING A VENTILATION SYSTEM WITH A MIXING CHAMBER

This application is a 35 U.S.C. §371 National Stage Application of PCT/EP2011/072329, filed on Dec. 9, 2011, which claims the benefit of priority to Serial No. DE 10 2011 000 525.0, filed on Feb. 4, 2011 in Germany, the disclosures of which are incorporated herein by reference in their entirety.

The disclosure relates to a method for operating a ventilation system with a mixing chamber according to the type specified herein and to a method for operating a ventilation system according to the type specified herein.

BACKGROUND

A mixing chamber of a ventilation system is fed by at least two air-supplying ducts which can supply, for example, fresh air and/or recirculated air. A fan is connected downstream of the mixing chamber and generates a negative pressure in the mixing chamber. The mixed air is supplied via a duct removing air from the mixing chamber to the fan, where the air is mixed further and is finally conducted in the ventilation system to the space to be ventilated or the spaces to be ventilated, according to requirements. It is also known in this case to supply the mixing chamber with more than two ducts.

Each supplying duct has in each case a supply air flap which can have a plurality of flap leaves. In conjunction with this application, the supply air flap or the flap is the entire unit which has at least one flap leaf. In the case of large supplying ducts, a plurality of flap leaves can also be combined to form flap units. The flap leaves of a flap unit are intercoupled in respect of the drive thereof. Said intercoupled flap leaves form a unit which in each case take up the same opening positions. A plurality of flap units here form a supply air flap. To differentiate therefrom, flap leaves are structurally combined in a frame. These are not flap units within the meaning of the disclosure.

As a rule, a plurality of flap leaves are provided per supply air flap or a plurality of flap units are provided per supply air flap. The flap leaves here are intercoupled in such a manner that the flap leaves each take up an identical opening position. The position of adjacent flap leaves with respect to one another is normally opposed, i.e. the opening angles are identical, since said flap leaves are intercoupled via a shaft and/or via a gearing, but the orientation of the flaps and the flap direction differ.

The opening positions of the supply air flaps of the two ducts supplying air to the mixing chamber are dependent on each other. For example, there is an opening position in one air-supplying duct of 90% and, in the other air-supplying duct of 10%. An opening position in both air-supplying ducts of 100% is also possible.

In the case of different opening positions, it is the aim of the mixing chamber to mix the air supplied via the two ducts of the mixing chamber together. However, it has turned out that, despite the negative pressure generated in the mixing chamber by a fan connected downstream of the mixing chamber, what are referred to as stratifications occur even downstream of said fan, that is to say that there can be, for example, temperature differences in the air in the duct removing air from the mixing chamber of up to 10° C. and more. This also occurs in the direction of flow downstream of the fan, by means of which the air of the two ducts is also mixed once again. The same applies to the other physical characteristic values, such as moisture, pressure and density, but also to the air quality, such as, for example, the oxygen content, pollutant content and $CO_2$ content.

It is known to solve this problem by means of fixed internals in the mixing chamber or in the duct leading away from the mixing chamber, as a rule what is referred to as the supply air duct, for example by means of perforated plates, deflecting plates, induction devices and the like. However, a problem of said fixed internals is that the resulting increased flow resistance is permanent irrespective of whether stratification can occur. Said internals permanently reduce the efficiency of the ventilation system. A stratification in the duct leading away will, however, occur only if the mixing chamber is supplied air with different physical characteristic values and/or air qualities, for example air having different temperatures.

SUMMARY

The disclosure is based on the object of developing a method for operating a ventilation system with a mixing chamber according to the type specified herein in such a manner that the preconditions for better thorough mixing, but also for greater efficiency of the ventilation system are created while avoiding the abovementioned disadvantages.

This object is achieved by the features described herein.

The disclosure is based on the finding that the kinetic energy of the air supplied to the mixing chamber is used in order to ensure better thorough mixing of the air in the mixing chamber. If the need arises, the flap leaves or the flap units now guide the air supplied by one duct in the direction of the other duct. This then results in the air flows coming into contact and in improved thorough mixing. The flow resistance is increased. If the air, for example, has the same temperature and therefore thorough mixing is not desired, the flap leaves are oriented with the effect of reducing the flow resistance. The flow resistance is therefore changed according to requirements in such a manner that the flaps are adjusted with the effect of better thorough mixing or minimizing the flow resistance. This ensures an individual activation of the flap leaves or of the flap units, thus enabling the efficiency of the ventilation system to be increased in a simple manner.

For structural reasons, in the case of ventilation systems having large duct cross sections, flap leaves can also be combined in a frame, said flap leaves then likewise forming structural units. If, however, the flap leaves are not intercoupled in terms of drive in the unit, said flap leaves are not flap units within the meaning of this patent application. According to the disclosure, the flap leaves in a structural unit are individually activated and driven. If, by contrast, flap units each having intercoupled flap leaves are provided, the flap units are individually activated and driven.

In particular in the event of a different distribution of the supplied air between two air-supplying ducts, the supplied air having the lower proportion of supplied air has to be guided in the direction of the other supply air duct in order to ensure better thorough mixing.

According to a first aspect of the disclosure, the flap leaves and/or the flap units are therefore activated individually. For this purpose, the flap leaves or flap units each have a dedicated drive. An individual opening position of the respective flap leaves or of the flap units with the flap leaves is therefore made possible. This creates the conditions for changing the orientation of the flap leaves according to requirements, specifically under the aspect of better thorough mixing, optimization of the flow resistance and/or optimization of the noise production.

According to one embodiment of the method according to the disclosure, for the improved thorough mixing, the flap leaves or the units of flap leaves of the flap units are oriented in such a manner that the air supplied from one duct is guided in the direction of the other supplying duct. The feature "in the direction of the other supplying duct" is unambiguous in respect of supplying ducts arranged at an angle to one another. In respect of mutually opposite supplying ducts, said feature should be understood as meaning that, for the purpose of better thorough mixing, the flap leaves are oriented in a direction away from the removing duct. The air is therefore first of all directed away from the removing duct before the negative pressure forces the air into the removing duct.

The requirement for good thorough mixing above all arises in the case of different physical characteristic values of the air, such as temperature, pressure, density and moisture, and/or in the case of a different quality of the air, such as oxygen content, $CO_2$ content and pollutant content, in the individual supplying ducts. To this extent, the thorough mixing is optimized by orientation of the flap leaves in these cases.

According to a further embodiment of the method according to the disclosure, in order to save on energy, the individual flap leaves and/or the units of flap leaves of the flap units are oriented in such a manner that the air supplied via the supplying ducts is guided in the direction of the removing duct.

The requirement for saving on energy above all arises in the case of approximately identical physical characteristic values of the air, such as temperature, pressure, density and moisture, and/or in the case of an approximately identical quality of the air, such as oxygen content, $CO_2$ content and pollutant content, in the individual supplying ducts. Thorough mixing is then not required, since the physical characteristic values and/or the quality of the air from the supplying ducts are/is identical. In this respect, the saving on energy can then readily be optimized by orientation of the flap leaves.

In order to control the flap leaves in a corresponding manner for thorough mixing and/or for saving on energy, the physical characteristic values of the air in the supplying ducts and/or the quality of the air in the supplying ducts are/is preferably determined via sensors.

According to a further embodiment of the method according to the disclosure, depending on the quantity of air required from a supplying duct, only some of the flap leaves and/or of the flap units with the flap leaves thereof are opened, in particular at different opening angles. By this means, the thorough mixing, on the one hand, but also the saving on energy, on the other hand, can be optimized.

This effect can be improved even further, according to one embodiment of the method according to the disclosure, if, depending on the orientation of the opening angle of the flap leaves for guiding the air—saving on energy, thorough mixing—a prioritized activation of the individual flap leaves or flap units, in respect of the sequence of flap leaves or flap units to be opened first, of the flaps assigned to the respective supplying ducts is undertaken.

More than two supplying ducts can also be provided, the flap leaves or flap units then being correspondingly controlled. It is also possible for a plurality of removing ducts to be provided.

According to another aspect of the method for operating a ventilation system with a mixing chamber, air is supplied into said mixing chamber via a first supplying duct and via at least one further supplying duct. Air is removed from the mixing chamber via a removing duct. The supply of air—volume control—into the mixing chamber from the supplying ducts is controlled in each case via flaps each having at least one flap leaf. According to the disclosure, for the improved thorough mixing, the flap leaf is in each case oriented in such a manner that the air supplied in the one supplying duct is guided in the direction of the other supplying duct. To save on energy, the flap leaf is then oriented in such a manner that the supplied air is guided in the direction of the removing duct. Depending on the requirements—better thorough mixing or saving on energy—the flap leaves are therefore pivoted into different opening positions and orientations.

In particular, in the case of different physical characteristic values of the air, such as temperature, pressure, density and moisture, and/or in the case of a different quality of the air, such as oxygen content, $CO_2$ content and pollutant content, in the individual supplying ducts, the thorough mixing is optimized by orientation of the flap leaves.

By contrast, in the case of approximately identical physical characteristic values of the air, such as temperature, pressure, density and moisture, and/or in the case of an approximately identical quality of the air, such as oxygen content, $CO_2$ content and pollutant content, in the individual supplying ducts, the saving on energy can be optimized by orientation of the flap leaves. The orientation of the flap leaves and the requirement are therefore determined on the basis of identical or different physical characteristic values and/or air qualities. In addition or alternatively, the flap leaves can also be oriented in relation to optimizing the noise production in the mixing chamber.

BRIEF DESCRIPTION OF THE DRAWINGS

Further advantages, features and use possibilities of the present disclosure emerge from the description below in conjunction with the exemplary embodiments illustrated in the drawings.

The description, the claims and the drawings make use of the terms and associated reference numbers used in the list of reference numbers cited below. In the drawings:

DETAILED DESCRIPTION

Figure 1:
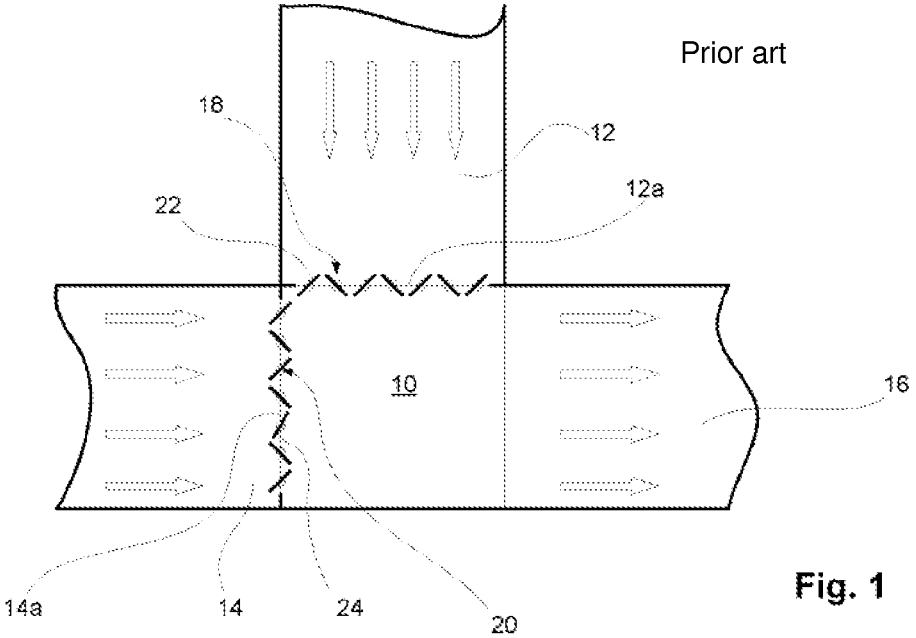
FIG. 1 is a schematic view of a mixing chamber with two ducts supplying air to the mixing chamber and one duct removing air from the mixing chamber, with control of the flap leaves according to the prior art.

FIG. 1 illustrates a schematic view of a mixing chamber 10 of a ventilation system with two ducts 12 and 14 supplying air to the mixing chamber 10 and a duct 16 removing air from the mixing chamber 10, according to the prior art. The first air-supplying duct 12 is arranged at a right angle in relation to the second air-supplying duct 14. The removing duct 16 is arranged opposite the second supplying duct 14. The mixing chamber 10 is located inbetween. The inlet 12*a*, 14*a* of each supplying duct 12, 14 has a respective supply air flap 18, 20. Each supply air flap 18, 20 is provided with a plurality of flap leaves 22 and 24 intercoupled via a gearing. The flap leaves 22, 24 are intercoupled in such a manner that they each take up identical opening angles in a supply air flap 18, 20. However, as illustrated in FIG. 1, said flap leaves can be oriented in an opposed manner adjacent to one another, but can have an identical opening angle.

In the exemplary embodiment according to FIG. 1, the flap leaves 22 of the supply air flap 18 and also the flap leaves 24 of the supply air flap 20 have an opening angle of 45°. A 50:50 mixing of the air supplied from the first supply air duct 12 with the air from the second supply air duct 14 arises in the mixing chamber 10. A fan (not illustrated here) is connected downstream of the mixing chamber 10, the fan generating a negative pressure in the mixing chamber 10 and also in the supplying ducts 12 and 14 and removing the supplied air via the removing duct 16.

Fans can also be installed in the supplying ducts 12, 14, said fans pressing the supplied air into the mixing chamber 10 and out of the latter again into the removing duct 16.

By way of example, at great temperature differences in the air supplied in the first supply air duct 12 in relation to the second supply air duct 14, what are referred to as stratifications can occur in the duct 16 removing air from the mixing chamber, said stratifications still remaining even after passing the fan connected downstream of the mixing chamber 10. Stratifications of this type may have temperature differences of, for example, 10° C. and more, which is not desirable.

According to the disclosure, each flap leaf 22 or 24 is therefore individually driven and activated. This results in diverse use possibilities for optimizing the thorough mixing, but also for saving on energy in the ventilation system and therefore in possibilities of increasing the efficiency of the ventilation system.

Figure 2:
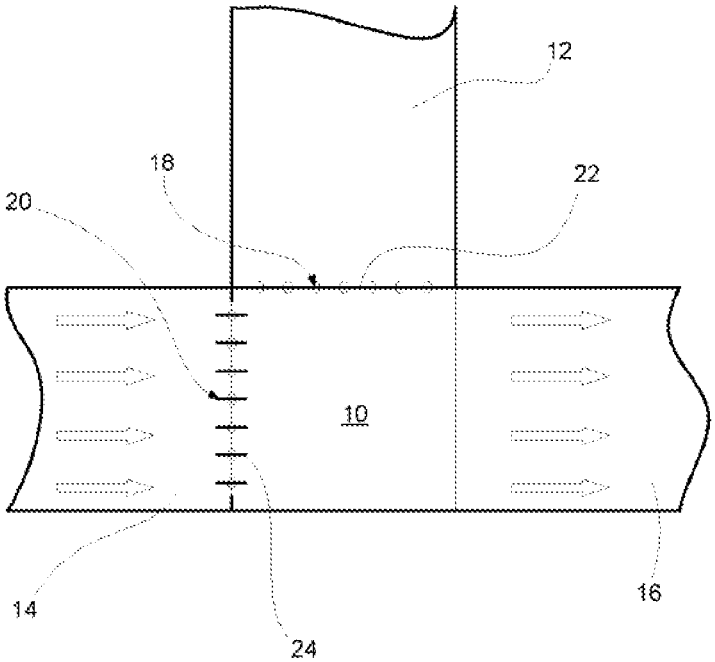
FIG. 2 is a schematic view of a mixing chamber with the two ducts supplying air to the mixing chamber and the duct removing air from the mixing chamber, with a control of the flap leaves according to the disclosure for the case in which no air is supplied to the mixing chamber from the second supplying duct.

FIG. 2 illustrates, in a schematic view, a mixing chamber 10 with the two ducts 12 and 14 supplying air to the mixing chamber 10 and with the duct 16 removing air from the mixing chamber 10. In the present case, the first supplying duct 12 is closed by the flap leaves 22. By contrast, the flap leaves 24 are completely open. Each flap leaf 22 of the supply air flap 18 and each flap leaf 24 of the supply air flap 20 are driven by a dedicated motor and activated individually here. Each flap leaf can therefore move individually and take up a dedicated opening angle, as becomes clear with reference to FIGS. 3 to 8 below.

Figure 3:
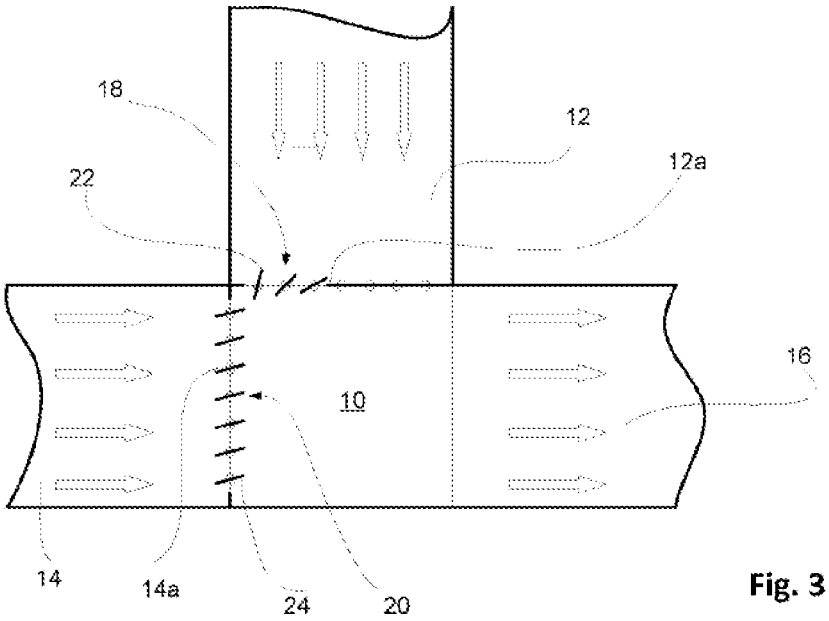
FIG. 3 is a schematic view of a mixing chamber with the two ducts supplying air to the mixing chamber and with the duct removing air from the mixing chamber, with control of the flap leaves according to the disclosure for the situation in which only some of the air from the second duct supplying air to the mixing chamber is supplied to the mixing chamber, and the air from the first and second ducts is intended to be thoroughly mixed in the mixing chamber.

FIG. 3 illustrates a thorough mixing situation. In this case, by way of example, 90% of the air from the supplying duct 14 and 10% of the air from the supplying duct 12 are supplied to the mixing chamber 10. These are volumetric ratios. For this purpose, the flap leaves 24 of the supply air flap 20 are all opened and oriented in the direction of the first supply air duct 12. In the case of the supply air flap 18, only some of the flap leaves 22 are opened, but at a differing opening angle. However, the flap leaves 22 are also oriented here in the direction of the other supply air duct, namely the second supply air duct 14. By this means, the air flows from the duct 12 and from the duct 14 are directed at one another; turbulences occur and therefore optimized mixing in the mixing chamber 10 occurs. Stratifications in the subsequent removing duct 16 are therefore avoided.

Figure 4:
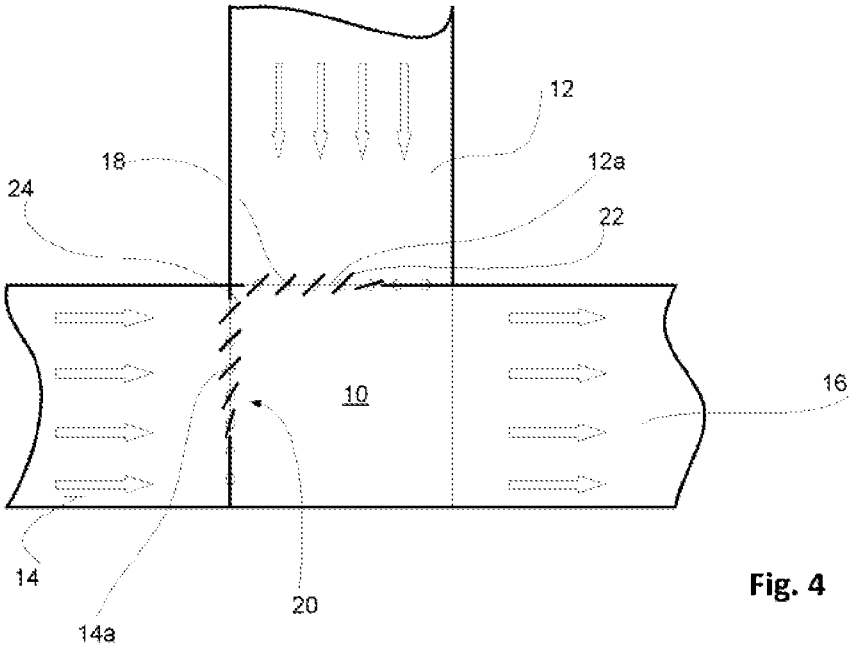
FIG. 4 is a schematic view of a mixing chamber with the two ducts supplying air to the mixing chamber and with the duct removing air from the mixing chamber, with control of the flap leaves according to the disclosure for the situation in which only some of the air from the first and second ducts supplying air to the mixing chamber is supplied to the mixing chamber, and the air from the first and second ducts is intended to be thoroughly mixed in the mixing chamber.

FIG. 4 shows a further thorough mixing situation, wherein, in this case, approximately 60% of air from the first supply air duct 12 and 40% of air from the second supply air duct 14 are supplied to the mixing chamber 10. In this case, the flap leaves 22 of the supply air flap 18 and also the flap leaves 24 of the supply air flap 20 are provided with different opening angles, but are all oriented at the respectively other supply air duct or the inlet 12*a*, 14*a* thereof to the mixing chamber 10.

Figure 5:
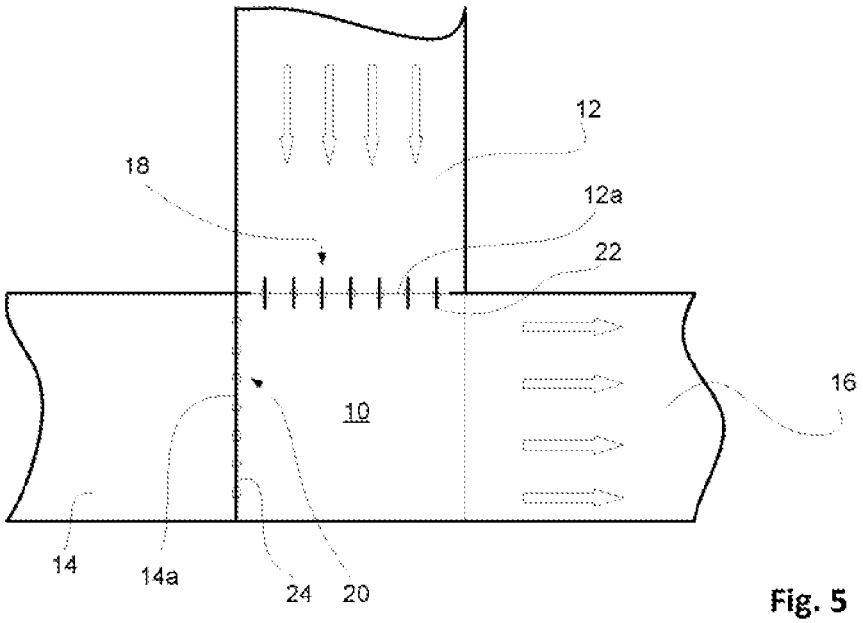
FIG. 5 is a schematic view of a mixing chamber with two ducts supplying air to a mixing chamber and with a duct removing air from the mixing chamber, with control of the flap leaves according to the disclosure for the situation in which no air is supplied to the mixing chamber from the first supplying duct.

FIG. 5 illustrates the case in which the supply air flap 20 is closed, i.e. the flap leaves 24 of the supply air flap 20 are all closed. By contrast, the flap leaves 22 of the supply air flap 18 are all opened at an identical opening angle. Therefore, only air from the first supply air duct 12 is supplied to the mixing chamber 10 and is further directed from there via the air-removing duct 16 in the ventilation system.

Figure 6:
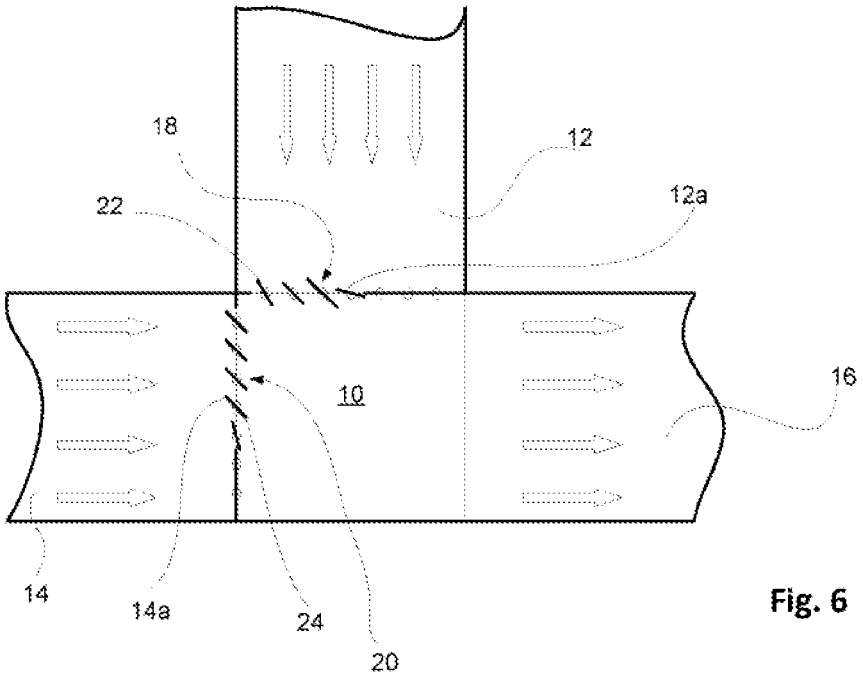
FIG. 6 is a schematic view of a mixing chamber with the two ducts supplying air to the mixing chamber and with the duct removing air from the mixing chamber, with control of the flap leaves according to the disclosure for the situation in which only some of the air from the first and second ducts supplying air to the mixing chamber is supplied to the mixing chamber, and there is intended to be little flow resistance for the air supplying the mixing chamber and therefore a saving on energy.

FIG. 6 illustrates the situation in which the primary object of the mixing chamber is not the thorough mixing but rather as great a reduction as possible in the flow resistance, i.e. a saving on energy. In this case, the flap leaves 22 of the supply air flap 18 and the flap leaves 24 of the supply air flap 20 are directed away from the respectively other supplying duct 12 or 14, namely in the direction of the air-removing duct 16. This considerably reduces the flow resistance, and an optimized saving on energy in the ventilation system occurs.

Figure 7:
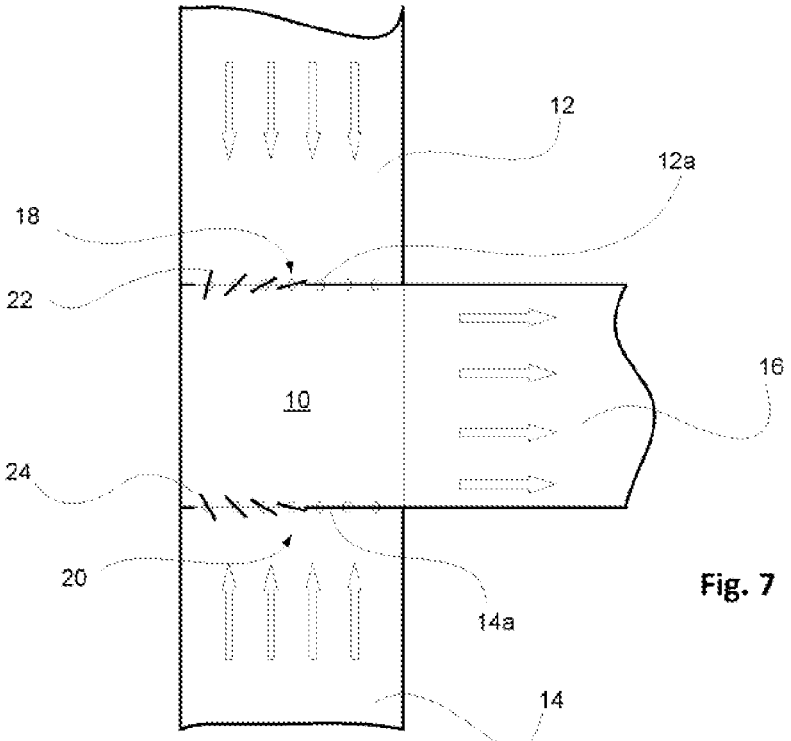
FIG. 7 is a schematic view of a mixing chamber with the two ducts supplying air to the mixing chamber and with the duct removing air from the mixing chamber, with control of the flap leaves according to the disclosure for the situation in which only some of the air from the first and second ducts supplying air to the mixing chamber is supplied to the mixing chamber, and the air from the first and second ducts is intended to be thoroughly mixed in the mixing chamber, wherein the supplying ducts are arranged opposite one another.
Figure 8:
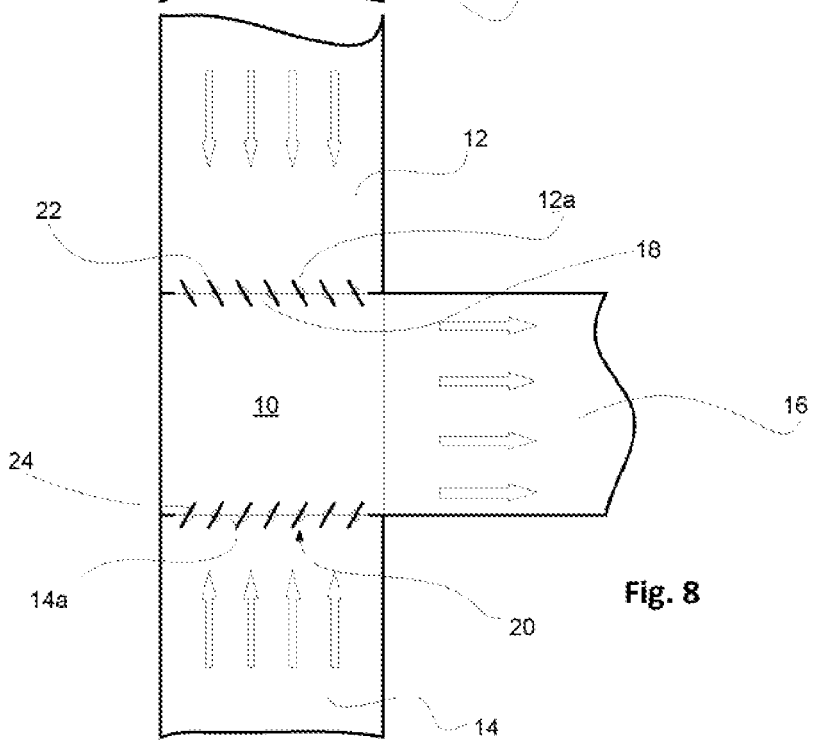
FIG. 8 is a schematic view of a mixing chamber with the two ducts supplying air to the mixing chamber and with the duct removing air from the mixing chamber, with control of the flap leaves according to the disclosure for the situation in which only some of the air from the first and second ducts supplying air to the mixing chamber is supplied to the mixing chamber, and there is intended to be little flow resistance for the air supplying the mixing chamber and therefore a saving on energy, wherein the supplying ducts are arranged opposite one another.

FIGS. 7 and 8 illustrate a further variant of a ventilation system with a mixing chamber 10. In this case, the two supplying ducts 12 and 14 are arranged opposite each other. In this case, FIG. 7 shows the thorough mixing situation and FIG. 8 shows the energy saving situation.

In FIG. 7, the flap leaves 22 of the supply air flap 18, on the one hand, and the flap leaves 24 of the supply air flap 20, on the other hand, are directed away from the removing duct 16. This causes an inflow from the first supply air duct 12 and from the second supply air duct 14 in such a manner that the flows are directed away from the removing duct 16, then meet one another, resulting in turbulences and therefore in an optimized thorough mixing in the mixing chamber 10. The flow here is in each case conducted away from the removing duct 16 by the flap leaves 22 and 24.

The situation in FIG. 8 differs; here, the flap leaves 22 of the supply air duct 18 and the flap leaves 24 of the supply air duct 20 are oriented in the direction of the removing duct 16. This reduces the flow resistance and thereby optimizes the ventilation system with the effect of saving on energy.

According to an embodiment (not illustrated here), a plurality of flap leaves 22, 24 can also be combined to form flap units. Flap units of this type are provided in particular in supplying ducts 12, 14 having large duct cross sections. In this case, a plurality of flap leaves 22, 24 of flap units can be intercoupled to one another. The resulting subunits are then activated individually and have a dedicated drive. The units can therefore move the flap leaves 22, 24 thereof in each case individually of the other units and, for this purpose, have the corresponding drives with gearings and/or servomotors. Otherwise, the units are correspondingly controlled, as has been illustrated with reference to FIGS. 2 to 8 for the flap leaves 22, 24.

In the case of supplying ducts 12, 14 with a small diameter and only one flap leaf 22, 24, this is designed in such a manner that, for the thorough mixing situation, the flap leaf 22, 24 of the one supply air flap 18, 20 of the one supplying duct 12, 14 can be oriented in the direction of the other supplying duct 12, 14, and, for the energy saving situation, can be oriented in the direction of the removing duct 16. This enables the inventive disclosed concept to be readily simply converted also for ventilation systems with one flap leaf 22, 24.

In principle, the thorough mixing situation of the flap leaves 22, 24 or of the units of flap leaves 22, 24 depends on different physical characteristic values of the supplied air, such as temperature, pressure, density and moisture or on a different quality of the air, such as oxygen content, $CO_2$ content and pollutant content in the individual supplying ducts 12, 14. If there are differences here, the system, and therefore the flap leaves 22, 24, can be correspondingly adjusted and oriented for optimized thorough mixing, as has been described above. If, however, the physical characteristic values or the air quality in the supplying ducts is intended to be identical or at least approximately identical, the flap leaves 22, 24 can be controlled with the effect of optimizing the energy of the ventilation system, i.e. with the effect of orienting the flap leaves 22, 24 with as little flow resistance as possible.

In order in each case to detect the individual situations, sensors (not illustrated here) which interact with a central computer unit are provided in the supplying ducts 12, 14. In the central computer unit, by comparing the determined physical characteristic values of the air or the characteristic values for the quality of the air, a decision is made as to how the flap leaves are oriented, i.e. the mixing ratio in which the air from the one supplying duct 12, 14 is mixed with the air from the other air-supplying duct 12, 14, but also whether there is a thorough mixing situation or an energy saving situation.

Depending on the quantity of air required from a supplying duct 12, 14, all or only some of the flap leaves 22, 24 are opened. As has been explained, for an opening of some of the flap leaves 22, 24, it is also possible for the flap leaves 22, 24 to have different opening angles.

Furthermore, the flap leaves 22, 24 are activated in a prioritized manner by the central computer unit in order to achieve optimized thorough mixing or optimized saving on energy. In this case, the individual flap leaves 22, 24 or flap units are activated in respect of the sequence of flap leaves 22, 24 or flap units to be opened first and to be opened last.

Irrespective of the air quality and the physical characteristic values, it is then also possible to control the flap leaves 22, 24 or the flap units with the effect of an optimized noise production. A control of this type is dependent on the air required, on the physical characteristic values, on the air quality, on the mixing requirement and on the energy saving requirement, and on the flow resistance occurring by means of the position of the flap leaves and also on the orientation of the flap leaves. Depending on the application, different orientations and flap positions of the respective supply air flaps are produced with the effect of optimizing the noise.

LIST OF REFERENCE NUMBERS

10 Mixing chamber
12 First air-supplying duct
12*a* Inlet to the mixing chamber
14 Second air-supplying duct
14*a* Inlet to the mixing chamber
18 Supply air flap of the first supplying duct
20 Supply air flap of the second supplying duct
22 Flap leaf of the supply air flap 18
24 Flap leaf of the supply air flap 20

The invention claimed is:

1. A method for operating a ventilation system comprising:

supplying first air into a mixing chamber via a first supplying duct by controlling a first plurality of flaps having at least one of (i) a first plurality of flap leaves and (ii) a first plurality of flap units, each of the first plurality of flap units having a first plurality of intercoupled flap leaves, by individually activating at least one of the first plurality of flaps such that each of the first plurality of flaps has a respective individual opening position;

supplying second air into the mixing chamber via a second supplying duct by controlling a second plurality of flaps having at least one of (i) a second plurality of flap leaves and (ii) a second plurality of flap units, each of the second plurality of flap units having a second plurality of intercoupled flap leaves, by individually activating at least one of the second plurality of flaps such that each of the second plurality of flaps has a respective individual opening position;

mixing the first air with the second air using different flow resistances based on differences between at least one of (i) physical characteristic values of the first air and quality values of the first air and (ii) corresponding physical characteristic values of the second air and quality values of the second air, wherein:

increasing the flow resistance includes orienting at least one of the first plurality of flaps and the second plurality of flaps such that the first air supplied from the first supplying duct and the second air supplied from the second supplying duct are guided in a direction toward each relative to a removing duct; and reducing the flow resistance includes orienting at least one of the first plurality of flaps and the second plurality of flaps such that the first air supplied from the first supplying duct and the second air supplied from the second supplying duct are guided in a direction toward the removing duct relative to each other; and removing the mixed first air and second air from the mixing chamber via a removing duct.

2. The method as claimed in claim 1, wherein the mixing includes:

increasing the flow resistance in response to the at least one of the physical characteristic values of the first air and the quality values of the first air being different from the corresponding physical characteristic values of the second air and quality values of the second air.

3. The method as claimed in claim 2, further comprising:

determining the at least one of the physical characteristic values of the air in the supplying ducts and the quality of the air in the supplying ducts with sensors.

4. The method as claimed in claim 2, wherein the mixing includes:

reducing the flow resistance in response to at least one of physical characteristic values the first air and the quality values of the first air being approximately identical to the corresponding physical characteristic values of the second air and quality values of the second air.

5. The method as claimed in claim 2, further comprising:

selecting a portion of the at least one of the first plurality of flaps and the second plurality of flaps to open with reference to a quantity of air required from at least one of the first supplying duct and the second supplying duct.

6. The method as claimed in claim 5, further comprising:

opening individual flaps at different opening angles.

7. The method as claimed in claim 6, further comprising:

prioritizing a sequenced activation of the individual flaps with reference to the different opening angles of the individual flaps.

8. The method as claimed in claim 2, further comprising:

orienting the flaps to so as to reduce noise production in the mixing chamber.

9. The method as claimed in claim 2, wherein the at least one of the physical characteristic values and the quality values of the first and second air includes at least one of temperature, pressure, density, moisture, oxygen content, $CO_2$ content, and pollutant content of the air being different in the first supplying duct and the at least one further supplying duct.

10. A method for operating a ventilation system comprising:

supplying first air into a mixing chamber via a first supplying duct and supplying second air into the mixing chamber via a second supplying duct;

removing the first and second air from the mixing chamber via a removing duct;

controlling the supply of first air into the mixing chamber from the first supplying duct via at least one first flap having at least one of (i) at least one first flap leaf and (ii) at least one first flap unit, each first flap unit having a first plurality of interconnected flap leaves;

controlling the supply of second air into the mixing chamber from the second supplying duct via at least one second flap having at least one of (i) at least one second flap leaf and (ii) at least one second flap unit, each second flap unit having a second plurality of interconnected flap leaves; and mixing the first air with the second air using different flow resistances based on differences between at least one of physical characteristic values of the first air and quality values of the first air and corresponding physical characteristic values of the second air and quality values of the second air, wherein:

increasing the flow resistance includes orienting each flap such that the first air supplied from the first supplying duct and the second air supplied from the second supplying duct are guided in a direction toward each other relative to the removing duct; and decreasing the flow resistance includes orienting each flap such that the first air supplied from the first supplying duct and the second air supplied from the second supplying duct are guided in a direction toward the removing duct relative to each other.

11. The method as claimed in claim 10, wherein the mixing includes:

increasing the flow resistance in response to at least one of physical characteristic values of the first air and quality values of the first air being different from corresponding physical characteristic values of the second air and quality values of the second air.

12. The method as claimed in claim 10, wherein the mixing includes:

decreasing the flow resistance in response to at least one of physical characteristic values of the air and quality values the first air being approximately identical to the corresponding physical characteristic values of the second air.

13. The method as claimed in claim 10, wherein the at least one of the physical characteristic values and the quality values of the first and second air includes at least one of temperature, pressure, density, moisture, oxygen content, $CO_2$ content, and pollutant content of the air being different in the first supplying duct and the at least one further supplying duct.

* * * * *